US005524799A

United States Patent [19]

Skillin

[11] Patent Number: 5,524,799

[45] Date of Patent: Jun. 11, 1996

[54] DISPENSING CLOSURE EMPLOYING STANDARDS WITH BEARINGS TO RECEIVE SPOUT THEREIN

[75] Inventor: Clifford W. Skillin, Blackstone, Mass.

[73] Assignee: Polytop Corporation, Slatersville, R.I.

[21] Appl. No.: 339,182

[22] Filed: Nov. 10, 1994

[51] Int. Cl.[6] ..... B67D 3/00

[52] U.S. Cl. ..... 222/534; 222/536

[58] Field of Search ..... 222/531, 534, 222/536

[56] References Cited

U.S. PATENT DOCUMENTS

| | | | |
|---|---|---|---|
| 3,023,939 | 3/1962 | Gustafson | 222/536 |
| 3,111,245 | 11/1963 | Libit et al. | 222/534 |
| 3,251,516 | 5/1966 | Thomas | 222/534 X |
| 3,318,494 | 5/1967 | Porter et al. | 222/534 |
| 3,502,248 | 3/1970 | Libit et al. | 222/534 |
| 3,542,256 | 11/1970 | Waterman | 222/536 X |
| 3,734,359 | 5/1973 | Waterman | 222/536 X |
| 4,081,108 | 3/1978 | Wilson et al. | 222/536 X |
| 4,209,114 | 6/1980 | Wilson et al. | 222/536 |
| 4,219,138 | 8/1980 | Hazard | 222/534 |
| 4,519,529 | 5/1985 | Seltz | 222/536 X |
| 4,776,501 | 10/1988 | Ostrowsky | 222/534 X |
| 4,887,747 | 12/1989 | Ostrowsky et al. | 222/556 |
| 5,236,107 | 8/1993 | Spaanstra, Sr. | 222/534 |

FOREIGN PATENT DOCUMENTS

| | | | |
|---|---|---|---|
| 0402550 | 12/1990 | European Pat. Off. | 222/534 |

*Primary Examiner*—Andres Kashnikow
*Assistant Examiner*—Kenneth Bomberg
*Attorney, Agent, or Firm*—Hoffman, Wasson & Gitler

[57] ABSTRACT

A dispensing closure consisting of a cap with a cavity defined in its upper surface, and a spout to fit within the cavity. The spout has an enlarged base, and a central passage extending through the base and the remainder of the spout. Aligned trunnions are formed on the opposite sides of the base of the spout. An opening in the cap allows communication between the container upon which the cap is seated and the central passage in the spout. A pair of standards are integrally molded within the cavity in the cap, and one standard is situated on each side of the opening. A U-shaped bearing, with a slightly restricted opening, is located at the upper end of each standard and spaced fingers define the entrance into each bearing. The trunnions are forced downwardly into the opening in each bearing. The fingers deform momentarily to accept the trunnions and return to their unstressed condition to capture same, thus securing the spout to the cap and exerting a downwardly directed force upon the spout. The spout is mounted for pivotal movement between a closed position, and an opened position, which permits the discharge of the contents of the container. The sealing characteristics are materially improved by the addition of a flexible sealing flange surrounding the upper side of the opening through the cap.

9 Claims, 4 Drawing Sheets

DISPENSING CLOSURE EMPLOYING STANDARDS WITH BEARINGS TO RECEIVE SPOUT THEREIN

BACKGROUND OF THE INVENTION

1. Field of the Invention

The present invention pertains generally to dispensing closures comprising a cap with a spout pivotally mounted on the cap. More particularly, the present invention pertains to unique standards and bearings located within a cavity in the upper surface of the cap to receive, and retain, the spout therewithin.

2. Background

The term, or expression, "dispensing closure" identifies a two (or more) component structure comprising a cap adapted to be mounted upon a container, and a spout (or lid) mounted on the cap for pivotal movement between opened, and closed, positions. The cap has a cavity in its upper surface, with bearing openings formed in the walls defining the cavity. Trunnions (or axles) are located on opposite sides of the enlarged base of the spout, and the trunnions are snapped into place within the bearing openings during the assembly of the dispensing closure.

U.S. Pat. No. 3,023,939, granted Mar. 6, 1962, to Henry A. Gustafson, discloses a representative dispensing closure. The closure includes a cap (10) with a top surface (14) and a threaded skirt (16); an opening (22) extends through the top to establish communication with the passage (38) in the spout (40). Axles (32) on the spout (30) are pushed through a slot (28) on the top of the cap and snapped into engagement with bearing openings (26). The spout is thus secured to the cap for pivotal movement relative thereto. The base of the spout presses against O-ring seal (24) which surrounds the opening (22) and compresses same (as shown in FIG. 4) to minimize leakage.

Another dispensing closure, and one that lends itself to high speed injection molding techniques, can be molded within narrow tolerance, is easy to assemble, and can be produced at a competitive price, is set forth in U.S. Pat. No. 4,209,114, granted on Jun. 24, 1980 to Woodrow S. Wilson et al. Wilson et al discloses a dispensing closure comprising a cap (12) including two spaced, aligned bearings (42), and a pivotally mounted spout (30) with trunnions (40) that fit within the bearings. At least one of the components of the dispensing closure is formed of a material, such as a linear polyethylene, or polypropylene, which is sufficiently resilient that the trunnions may be snapped into the bearings during the assembly of the dispensing closure. The trunnions are tapered (as shown in FIGS. 4 and 5), and the entrances (44) into the bearing openings are formed of two, nearly flat sloping walls (46) with curved edges (48). The trunnions and bearing openings retain the enlarged base (28) of the spout in the proper relationship to the opening (22) in the cap that communicates with the interior of the container to which the dispensing closure has been secured.

Another dispensing closure that lends itself to high speed injection molding techniques, ease of assembly, low cost, etc. is shown in U.S. Pat. No. 4,219,138, granted Aug. 26, 1980, to Robert E. Hazard. The dispensing closure disclosed in such patent utilizes a washer spring (40; 140) situated about the opening (38) in the cap (12) of the closure. The washer spring, which is integrally molded with the cap, resiliently biases its sealing surface (such as bead or ring 46) against the base (34) of the spout (14) of the closure. Trunnions (32; 132) on the spout are snapped into engagement with bearing openings (28; 128) in the walls of the cap to secure the spout to the cap for pivotal movement relative thereto.

The foregoing dispensing closures functioned satisfactorily, under most circumstances, and met with consumer acceptance. Nonetheless, leakage, even on an infrequent basis, continued to be a problem. The need for sealing rings about the opening in the cap to combat leakage of the product in the container, as disclosed in the Gustafson patent, was obviated by the improved congruency of contacting surfaces achieved by the Wilson et al and Hazard dispensing closures. However, in order to maintain the congruent surfaces on the base of the spout and the cap in contact, tighter tolerances were imposed on the molded components. The tighter tolerances were difficult and costly to maintain with high speed injection molding equipment, and problems were encountered in assembling the spouts to the caps so that the congruency necessary for sealing was maintained, at all times. Furthermore, minor imperfections in the plastic being molded caused excessive abrasion on the contacting surfaces, so that leakage persisted as a constant, irritating problem with known dispensing closures.

SUMMARY OF THE INVENTION

Thus, with the deficiencies of the known dispensing closures discussed above clearly in mind, the present invention provides an improved dispensing closure that significantly reduces the leakage problem. The present invention is compatible with high speed injection molding equipment, and is designed to facilitate assembly of the spout to the cap. Furthermore, the dispensing closure, after assembly, maintains the desired congruency between the contacting surfaces of the spout and cap, with a reduced force, so that abrasion of contacting surfaces, is minimized and the sealing action is maintained over the useful life of the dispensing closure.

Also, the present invention can be practiced with diverse polymeric plastics, possessing varying degrees of resiliency.

Lastly, the present invention seals so effectively that the resultant dispensing closure can be utilized with a great variety of products, of varying viscosities, with equal effectiveness.

In the preferred embodiment, the present invention assumes the form of a pair of upstanding standards situated in proximity to the opening in the cap which communicates with the interior of the container upon which the dispensing closure has been secured. One standard is situated on each side of the opening, and the standards are parallel to each other. A U-shaped bearing, with a slightly restricted opening defined by spaced fingers, is located at the upper end of each standard. The trunnions on the opposite sides of the enlarged base of the spout are forced downwardly through the fingers and into each bearing. The fingers deform momentarily to accept the trunnions, and return to their unstressed condition to capture same, thus securing the spout to the cap. The fingers press the enlarged base of the spout downwardly against the curved surface of the cap in the vicinity of the opening in the cap, and the congruent surfaces close the opening and prevent leakage. The bearings enable pivotal movement of the spout between its closed position, and its upright, or opened position.

The unique vertically extending standards, with fingers and bearings, are easier to mold, with tighter tolerances, than the bearing openings formed in the walls of the cavities in caps of known dispensing closures. The standards and bearings minimize surface abrasion between the spouts and caps of the dispensing closures, seal effectively under all conditions, and can be molded with ease, and then removed from the molds, with a sharply reduced number of defects.

Furthermore, spaced fingers define an entrance into each bearing. The lateral distance across the entrance is selected to be somewhat less than the lateral distance, or diameter, of the bearing. After the trunnions on the spout are forced downwardly through the fingers and into the bearing, the fingers exert a downwardly directed force upon the spout. A resilient flange, or seal, is formed about the opening in the cap. The downwardly directed force transmitted through the base of the spout flexes the flange inwardly, and contributes to the enhanced sealing capability of the present dispensing closure.

Other advantages attributable to the present invention will become readily available to the skilled artisan, when the ensuing specification is construed in harmony with the appended drawings.

DESCRIPTION OF PREFERRED EMBODIMENT

Figure 1:
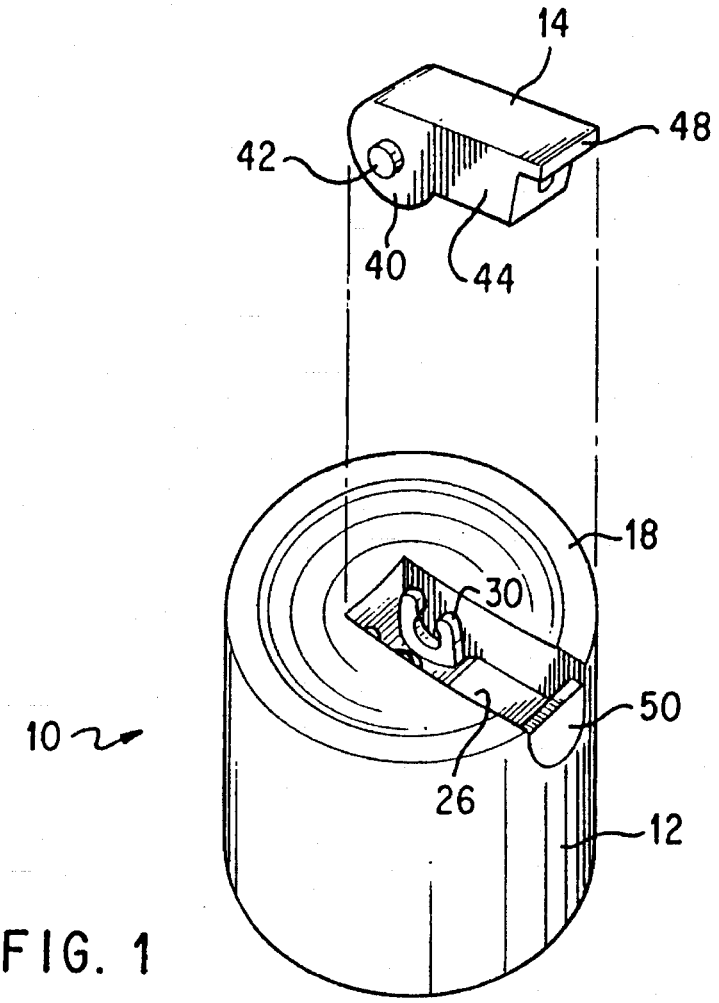
FIG. 1 is an exploded perspective of a dispensing closure constructed in accordance with the principles of the present invention, such view showing a cap, a spout, and standards within the cap to receive the spout.

FIG. 1 is an exploded perspective of a dispensing closure constructed in accordance with the principles of the present invention. The dispensing closure is indicated generally by reference numeral 10. Dispensing closure 10 comprises a cap 12 and a spout 14.

Figure 2:
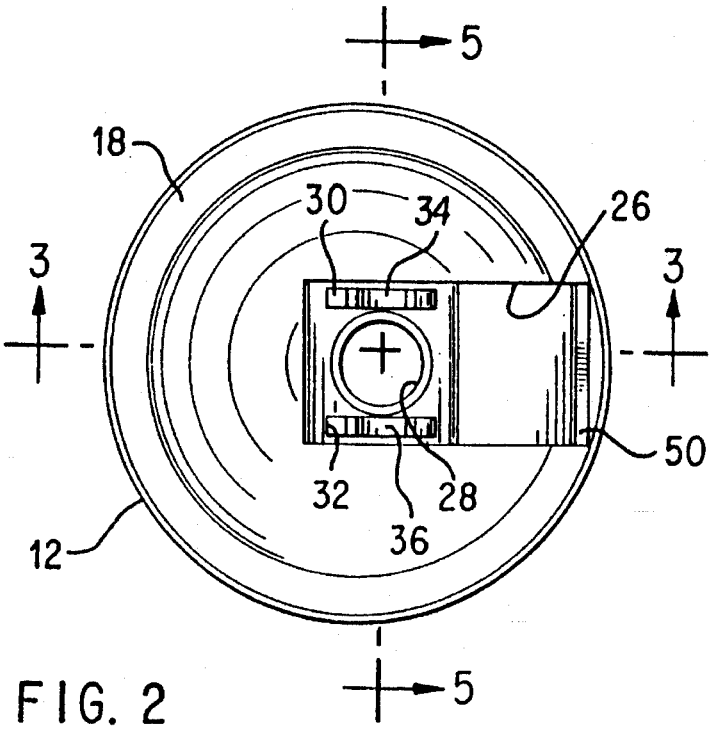
FIG. 2 is a top plan view of the cap of FIG. 1, with the spout removed.
Figure 3:
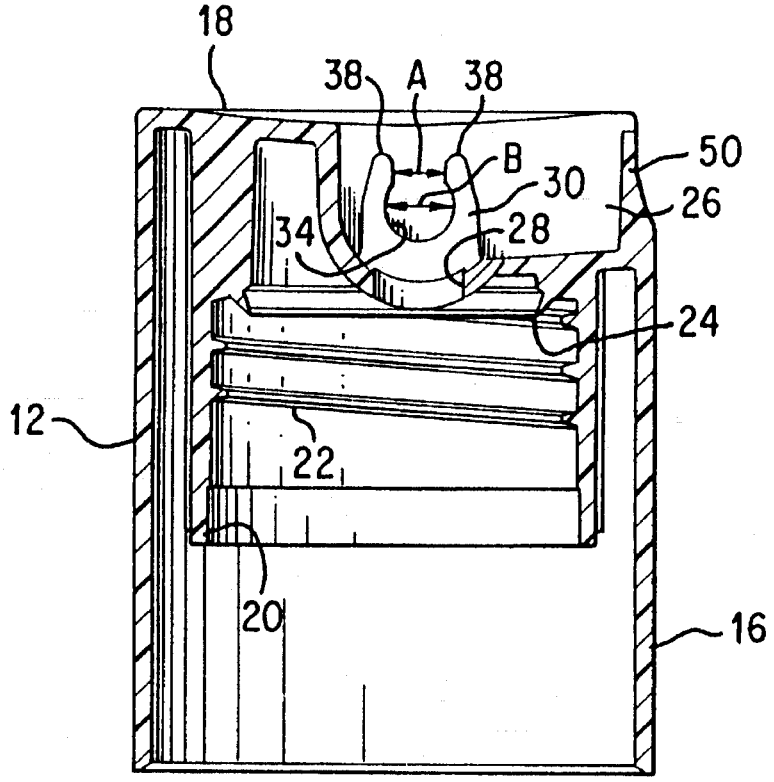
FIG. 3 is a vertical, cross-sectional view through the cap of FIG. 2, such view being taken along line 3—3 in FIG. 2, and in the direction indicated.

Cap 12, as shown in FIGS. 2 and 3, has a cylindrical skirt 16, an upper surface 18, and a short, depending plug 20 that is located radially inwardly of skirt 16. Surface 18 is slightly concave to minimize stresses and strains upon cap 12 during molding. Threads 22 are formed on the interior of plug 20, and the threads are engaged with complementary threads on the neck of the container (not shown) to which the dispensing closure is secured. Flange 24 seals against the upper end of the container (not shown).

A cavity 26 is defined in upper surface 18 to receive spout 14, and an opening 28 is molded within cap 12 to permit communication between the container and cavity 26. A first standard 30 is formed in cavity 26 adjacent to one side of opening 28, and a second standard 32 is formed in cavity 26 adjacent to the other side of opening 28. Standards 30, 32 are identical to each other, and are located parallel to one another, as shown in FIG. 2.

A bearing 34 is formed at the upper end of standard 30, and an identical bearing 36 is formed at the upper end of standard 32. Each bearing is generally U-shaped, with a slightly restricted opening A defined between the free ends of the fingers 38 located at the entrance to the bearing. As shown in FIG. 3, the lateral dimension A, at the entrance to the bearing, is somewhat less than the lateral distance B, or diameter, of the bearing.

Figure 4:
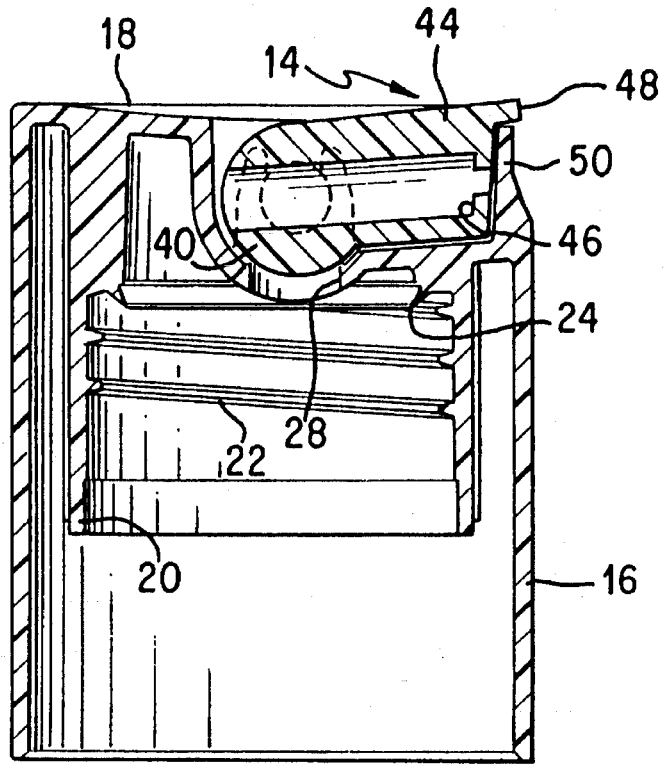
FIG. 4 is a vertical, cross-sectional view similar to FIG. 3, but showing the spout retained in a standard.
Figure 5:
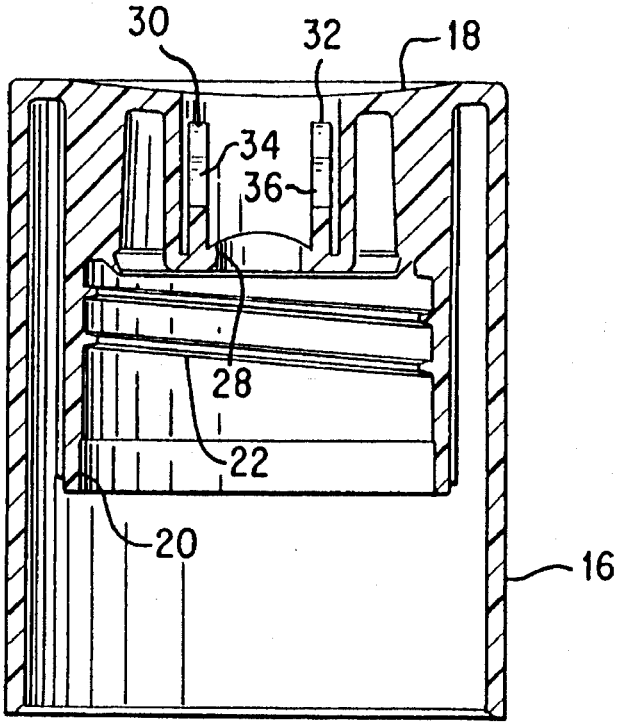
FIG. 5 is a vertical, cross-sectional view through the cap of FIG. 2, such view being taken along line 5—5 in FIG. 2, and in the direction indicated.
Figure 6:
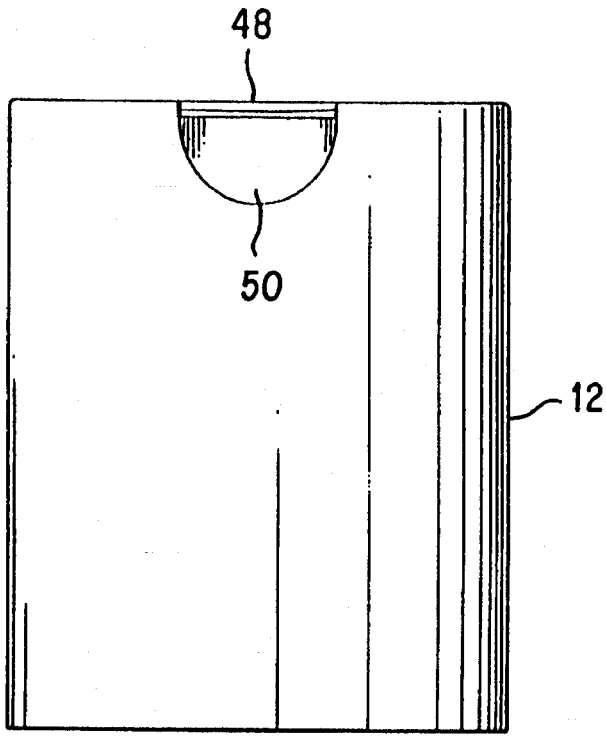
FIG. 6 is a front, elevational view of the cap of FIG. 2.

Spout 14, as shown in FIGS. 1 and 4, is an integrally molded member, comprising an enlarged cylindrical base 40 with aligned trunnions 42 extending from opposite sides thereof, and a body 44. A central passage 46 extends through base 40 and body 44, and a projecting lip 48 overhangs a depression 50 formed in the front wall of cavity 26.

Spout 14 is joined to cap 12 by pressing trunnions 42 on opposite sides of the spout downwardly into the arcuate bearings 34, 36 in parallel standards 30, 32. Trunnions 42 are slightly greater in diameter than dimension A at the entrance to the bearings. Fingers 38, which are integrally molded of somewhat resilient plastic along with the standards and bearings, momentarily deform to allow trunnions 42 access to the arcuate bearings. As the trunnions contact the bearings, the inherent resiliency of fingers 38 return same to their normal, unstressed condition. Trunnions 42 are captured by fingers 38 and retained in contact with bearings 34, 36 so that spout 14 can be pivoted relative to cap 12.

In addition to capturing trunnions 42 within the bearings, fingers 38 impart a downwardly directed force upon spout 14. Such force presses the curved surface of base 40 against the curved surface of cap 12 in the vicinity of opening 28, and maintains contact between these congruent surfaces. Such contact is of sufficient moment to provide a sealing action, yet is not great enough to cause surface abrasions therebetween. Surface abrasions can cause leakage, even when congruency is maintained between the contact surfaces.

Base 40 of spout 14 seals opening 28, and prevents communication between the underside of cap 12 and cavity 26, when the spout is in its closed position, as shown in FIG. 4. However, when one wishes to discharge the contents of the container to which dispensing closure 10 has been secured, one exerts an upwardly directed, prying force on lip 48. The spout is then pivoted upwardly, out of cavity 26 in cap 12, until it achieves a vertical orientation. In such alignment, the contents of the container may be discharged through opening 28 in cap 12 into central passage 46 of spout 14.

Figure 7:
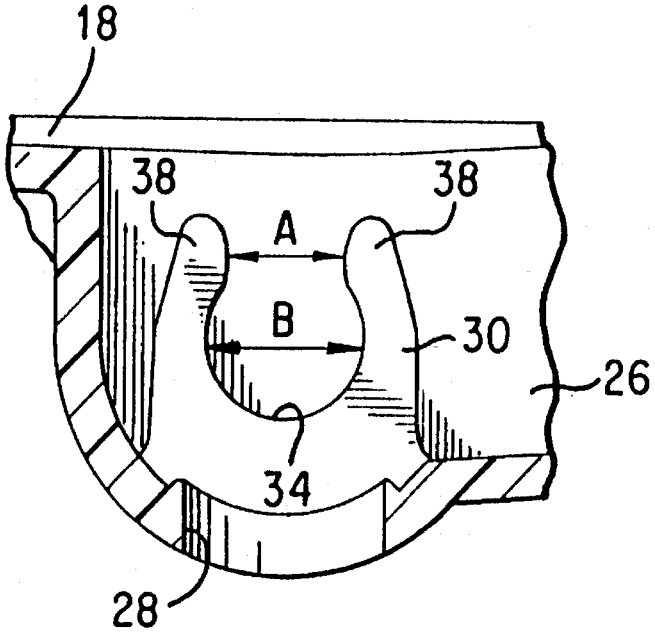
FIG. 7 is a fragmentary view, on an enlarged scale, of one of the standards formed in the cap of the dispensing closure.
Figure 8:
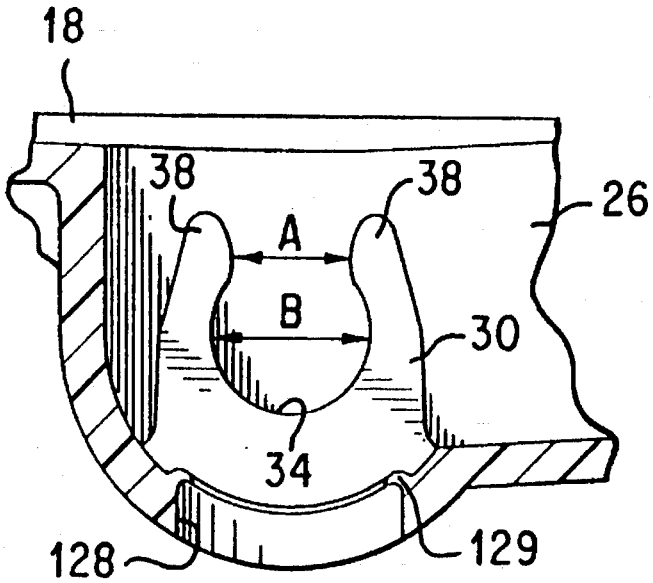
FIG. 8 is a fragmentary view, on an enlarged scale, of an alternative configuration of one of the standards formed in the cap of the dispensing closure, and showing the flange seal that surrounds the opening in the cap.

FIGS. 7 and 8 show standard 30 and bearing 34 on an enlarged scale. The relative dimensions A and B are also emphasized. No sealing ring is situated about opening 28 in FIG. 7.

FIG. 8 shows standard 30 and bearing 34 used in conjunction with an alternative cap 12; the opening 128 in the cap is surrounded by a flexible flange 129 that enhances the sealing about opening 128. The flange 129 yields inwardly when the base of spout 14 is pressed thereagainst by the downward force imposed by the fingers on the trunnions of spout 14. The inward flexing of flange 129 enhances the sealing action of the congruent surfaces on the spout and in the cap in the vicinity of opening 128. The net effect is a virtually leak-proof dispensing closure.

Yet other refinements, modifications, and the like, will occur to the skilled artisan from his, or her, consideration of the foregoing description. To illustrate, while trunnions 42 are cylindrical in shape, the bearings will function satisfactorily with tapered bearings, or bearings that are somewhat irregular in shape, since the downward force exerted by the fingers, in their unstressed normal condition, overcomes these aberrations in size and shape. Also, while surface 18 of cap 12 may be slightly concave, such surface may be planar, and the present invention will still function satisfactorily. Similarly, plug 20 may be omitted from the dispensing closure, and the interior skirt 16 may be threaded to allow the dispensing closure to be secured to a container for discharging the contents thereof. Consequently, the claims, which express the essence of the unique invention, should be construed broadly, and should not be restricted to their literal terms.

I claim:

1. A dispensing closure comprising:

a) a cap including a top surface, a skirt depending therefrom, means adapted to secure said cap to a container, side walls and a bottom wall defining a cavity within said top surface, and an opening in said top surface to establish communication with said cavity, b) a spout, said spout including an enlarged base, a body extending therefrom, and a central passage extending from said base through said body, c) trunnions formed on opposite sides of said base of said spout and in alignment with one another, d) standards spaced inwardly of said side walls of said cavity and located on opposite sides of said opening, e) said standards projecting upwardly from said bottom wall above said opening into said cavity, said standards free from contact with said side walls, f) bearings located on said standards, and g) said trunnions being snapped into engagement with said bearings on said standards so that said spout is secured within said cavity for pivotal movement relative to said cap.

2. A dispensing closure as defined in claim 1, wherein said standards are parallel to one another, and are identical in configuration.

3. A dispensing closure as defined in claim 1 wherein said cap is molded of a resilient polymeric plastic material, and said standards are integrally formed with said cap.

4. A dispensing closure as defined in claim 1 wherein said bearings consist of arcuate surfaces, and a pair of spaced fingers are formed at the upper end of each standard to define an entrance into each bearing.

5. A dispensing closure as defined in claim 4 wherein said fingers are momentarily deformed to allow the trunnions to pass therethrough and then return to unstressed state to exert a downwardly directed force upon the trunnions of the spout retained on the bearings.

6. A dispensing closure as defined in claim 4 wherein the lateral distance between said pair of fingers is less than the lateral distance across said bearing.

7. A dispensing closure as defined in claim 1 wherein a resilient flange encircles said opening, said flange being flexed inwardly as the base of said spout is pressed thereagainst to enhance the sealing capability of said dispensing closure.

8. A method of forming a two piece dispensing closure, such method including the steps of:

a) molding a plastic cap comprising a top surface, a skirt depending therefrom, means adapted to secure said cap to a container, a cavity defined by side walls and a bottom wall within said top surface, and an opening in said top surface to establish communication with said spout, b) molding a plastic spout including an elongated base, a body extending therefrom, a central passage through said body, and trunnions on opposite side of said base and in alignment with one another, c) molding a pair of standards spaced inwardly of said side walls and extending upwardly from said bottom wall and located on opposite sides of said opening in parallel relationship, said standards being molded free from contact with said side walls, d) molding resilient spaced fingers on said standards that provide an entrance into bearings on each standard, and e) pressing said trunnions on said spout between said fingers into engagement with said bearings, f) said fingers thereafter exerting a downwardly directed force upon said trunnions that presses said base of said spout into sealing engagement with said opening in said top surface of said cap.

9. The method of forming a two piece dispensing closure as recited in claim 8 wherein the molding operations recited in steps (a), (c), and (d) occur simultaneously, and said cap, standards, and bearings are integrally formed.

* * * * *